US006770016B1

(12) United States Patent
Anderson et al.

(10) Patent No.: US 6,770,016 B1
(45) Date of Patent: Aug. 3, 2004

(54) "THICK BAR" BARBELL WITH ROTATABLE SUPPORT FOR WEIGHT PLATES

(75) Inventors: Karl Anderson, Glendora, CA (US); Tom Grace, Vancouver, WA (US)

(73) Assignees: Ace Specialty, Inc., Rosemead, CA (US); Grace Premier Fitness and Wellness Products, Inc., Vancouver, WA (US)

( * ) Notice: Subject to any disclaimer, the term of this patent is extended or adjusted under 35 U.S.C. 154(b) by 258 days.

(21) Appl. No.: 09/932,153

(22) Filed: Aug. 17, 2001

(51) Int. Cl.[7] ..... A63B 21/072
(52) U.S. Cl. ..... 482/106; 482/50
(58) Field of Search ..... 432/44–46, 49, 432/50, 104, 106–108, 148

(56) References Cited

PUBLICATIONS

Power System 2000 Fall Winter Catalog, pp. 37,41 (Power Systems, Inc., Knoxville, TN).
Iron Mind, vol. 10, 2000–2001; pp. 20, 38, 40 (iron Mind Enterprises, Inc., (Nevada City, CA).
"Homemade Revolving Thick Bar"; The Grip Page; (date unknown); http://grippage.com/article.php?sid=3).
"Portable Grips For "Thick Bar" Holds"; The Grip Page; (date unknown); http://grippage.com/article.php?sid?sid=25).
"How To Make An Inexpensive Thick handled Bar"; Schutz; (date unknown); http://www.hardgainer.com/ideas/ideas001.html.
"How To Make Your Onw Thick Bar"; (date unknown); www.cyberpump.com/tips/tip45.html.
"The PDA Bar Clan"; (date unknown); http://fractional-plates.com/equipment/bars.html.
"Analu\ysis Of Thick Bar Lifting"; The Cable/Bar Guy; (date unknown); www.olympus.net/personal/cablebar/thick.htm.

*Primary Examiner*—Nicholas D. Lucchesi
*Assistant Examiner*—Tam Nguyen
(74) *Attorney, Agent, or Firm*—Robert A. Seldon

(57) ABSTRACT

The invention herein provides a "thick bar" barbell that permits free rotation of weight plates during weightlifting movements, weighs less than 50 lbs. and accommodates standard Olympic weight plates.

Briefly, the invention comprising a generally cylindrical bar of generally annular cross-section having an outer diameter of between approximately 1.5 inches and 3.5 inches and extending longitudinally between a pair of end regions. A rod member is securely inserted within each end region of the bar. Each rod member has an outer segment extending longitudinally outward beyond the respective end region of the bar, the segment having an O.D. less than the O.D. of the bar. Generally cylindrical sleeves are mounted on the outer segments of the rod members for rotation thereabout the bar's longitudinal axis, with a bushing between each of the rod segments and the respective sleeve. The outer diameter of each sleeve is sized to accommodate the 50 mm hole found in standard Olympic weight plates. In the preferred embodiment, material is drilled out of the rod to reduce the weight of the resultant barbell to a target weight without substantially adversely affecting the requisite degree of structural integrity needed to support the anticipated weight of the weight plates.

20 Claims, 1 Drawing Sheet

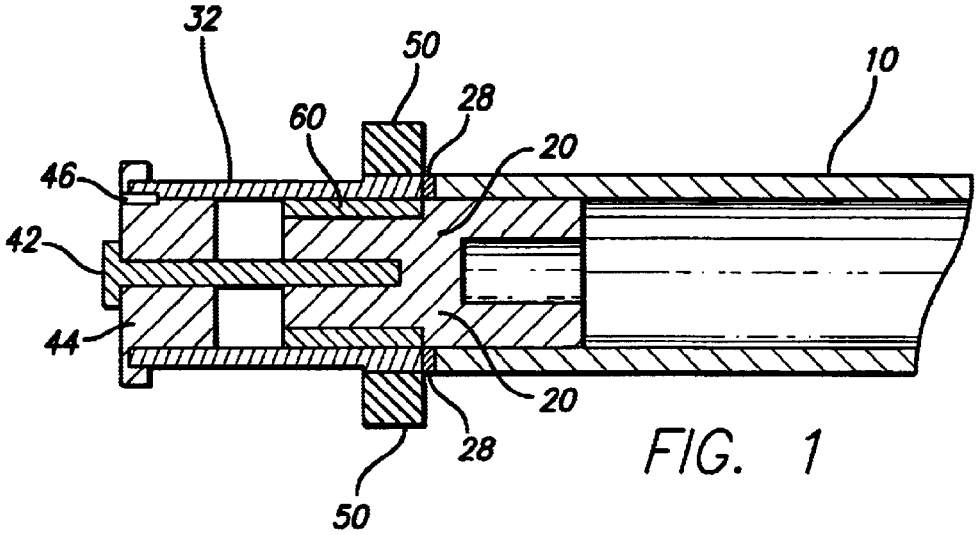
FIG. 1
FIG. 2
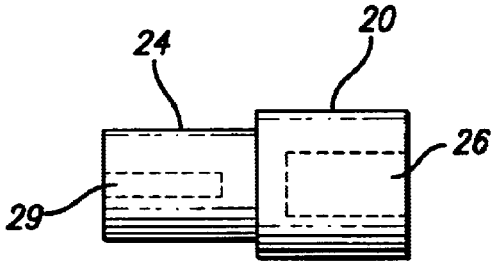
FIG. 3
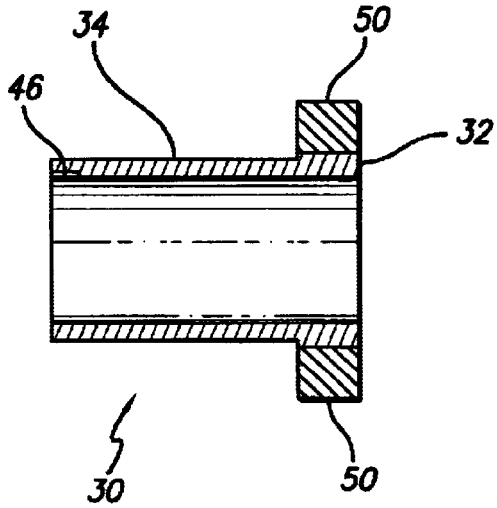
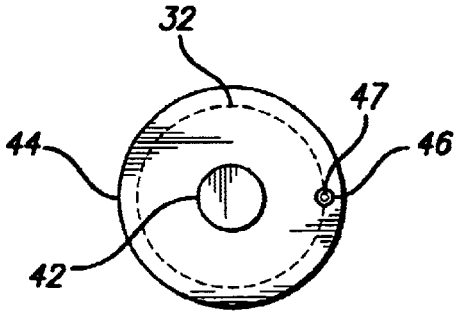
FIG. 4
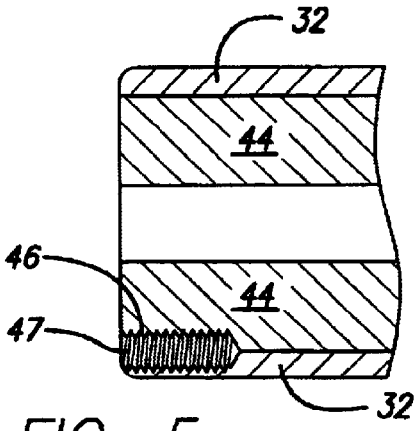
FIG. 5

"THICK BAR" BARBELL WITH ROTATABLE SUPPORT FOR WEIGHT PLATES

FIELD OF THE INVENTION

This invention pertains to barbells and dumbbells (hereinafter collectively, "bar bells"), and more specifically to the type of barbell and dumbbell known in the fitness industry and in athletics as a "thick bar" or, alternatively, a "fat bar".

Thick bars have handles of substantially greater outer diameter ("O.D."), at least in the region gripped by the user, than the handles of conventional bars. While the handles of conventional barbells and dumbbells have outer diameters of 27–33 mm (1.062–1.3 inches), the outer diameter of a thick bar handle is typically 50–77 mm (approx. 2–3 inches). As used herein, the term "thick bar" will be used to mean a bar bell or dumbbell having a handle with an O.D. equal to or greater than approximately 45 mm (approx. 1¾ inches) in the regions gripped by the user.

Thick bars are favored by serious strength athletes (including weightlifters) to build the powerful grip highly desired by competitors in those fields. By having to grab and hold on to an O.D. equal to or greater than approximately 45 mm during training, the athlete is constantly recruiting all of the synergistic muscles in the hand, wrist and forearm. Compared with using conventional barbells and dumbbells, the athlete has to work harder to hold and balance the larger O.D. handle. This harder effort promotes more rapid muscular development in the forearms and hands. This increased muscular development helps reduce injuries to the hand and forearm, and helps develop a powerful grip.

Previous attempts at producing thick handle barbells and dumbbells have suffered from the serious deficiency of not having a rotatable sleeve. Without a rotating sleeve, weight plates mounted on the ends of the thick bar cannot rotate smoothly, if at all, about the axis of the bar during normal lifting movements. During lifting, especially with rotational lifting movements, weight plates which cannot rotate freely generate a substantial torque that transfers back to the lifter's wrist/skeletal system. The weight lifted by serious strength athletes ranges from 100–500 lbs. or more, and the torque transfer can not only be painful, but can also cause an "overuse injury" to the athlete. For safety and comfort reasons, a rotating sleeve on a thick bar makes strength training more productive and safer.

An additional and strong preference in the athletic community is that thick bars accommodate standard "Olympic" plates. As is known in the art, Olympic plates have a central bar-accommodating hole sized to accommodate a bar having a 50 millimeter O.D. Olympic plates are readily available and are used in virtually all weightlifting contests.

Another strong preference is that the weight of the thick bar handle be somewhere between 40–50 lbs. so that it approximates the weight of a conventional barbell handle (approx. 45 lbs. (20 kg.)).

SUMMARY OF THE INVENTION

The invention herein provides a thick bar that permits free rotation of weight plates during weightlifting movements. In its preferred embodiment, a thick bar constructed in accordance with the invention weighs less than 50 lbs., and accommodates Olympic weights.

Briefly, the invention herein is a barbell comprising a generally cylindrical bar of generally annular cross-section having an outer diameter of between approximately 1.5 inches and 3.5 inches and extending longitudinally between a pair of end regions. A rod member is securely inserted within each end region of the bar. Each rod member has an outer segment extending longitudinally outward beyond the respective end region of the bar, the segment having an O.D. less than the O.D. of the bar.

Generally cylindrical sleeves are mounted on the outer segments of the rod members for rotation thereabout the bar's longitudinal axis. The outer diameter of each sleeve is sized to accommodate the central hole of one or more weight plates.

Dumbbells differ from barbells in the longitudinal dimension, but can be constructed in the same manner as the foregoing barbell. For the sake of brevity, the term "barbell" will accordingly be used to collectively mean barbells and dumbbells when referring to, and when claiming, the invention.

Additional details concerning the invention will be apparent to those of ordinary skill in the art from the following description of the preferred embodiment, of which the Drawing forms a part.

DESCRIPTION OF THE DRAWING

FIG. 1 is a fragmentary front sectional view of one end region of a barbell constructed in accordance with the invention;

FIG. 2 is a front view of the rod 20 illustrated in FIG. 1;

FIG. 3 is a longitudinal sectional view of the sleeve 30 illustrated in FIG. 1;

FIG. 4 is a left side view of the barbell of FIG. 1, showing a preferred end plug; and FIG. 5 is a fragmentary sectional view of the left end plug and sleeve, showing the set screw 47 tightened into the aperture 46.

DESCRIPTION OF THE PREFERRED EMBODIMENT

FIG. 1 is a fragmentary front sectional view of one end region of a barbell constructed in accordance with the invention. It will be understood that the fragment shown is one of two end regions of the bar, and that the other end region is identically configured. The illustrated barbell comprises a tubular bar 10 having an O.D. of 1.5 to 3 inches, and typically 2 inches. In practice, the length of a bar for a barbell is 53 inches, while the length of a bar for a dumbbell is 5.5 inches. Bars longer and shorter than these lengths are, of course, also used and are within the scope of the invention.

Preferably, the bar is made from "drawn over mandrel" ("DOM") steel tubing with a wall thickness of 3/16" with a tolerance of +0.000 and −0.005 inches. The resulting bar provides the requisite strength for safely lifting weights in the range of up to approximately 500 lbs.

As will be appreciated, a tubular bar results in immediate weight savings. A solid steel bar of the same outer diameter can easily exceed 80 lbs., be difficult to maneuver during set-up and storage, and make weight calculations based on the plates' stamped indicia grossly inaccurate.

A cylindrical rod 20, illustrated in FIGS. 1 and 2, is inserted into each end of the tubular bar 10 to a preferred minimum depth of 2.5–3 inches and with an preferred interference fit of 0.002–0.003 inches. The rod is preferably inserted with a press, and preferably made from the same material as the bar 10. The depth of insertion and the degree of fit provide the requisite degrees of strength and stability when foreseeable weight is lifted with the bar. In practice, it may be preferable to increase the degree of penetration when extremely heavy weights are to be lifted.

The rod 20 includes a segment 24 of comparatively reduced O.D. which extends longitudinally outward from the bar 10; typically, for approximately 10.5 inches. The O.D. of the segment 24 is sufficient to provide the structural strength needed to support the anticipated weight of the weight plates, but small enough to accommodate the remaining components of the barbell as described below, preferably including Olympic weight plates with the standardized central 50 mm holes. In practice, an O.D. of 1⅜ inches for the segment 24 has been found suitable to support 500 lbs. of weight when the rod is steel. Naturally, other materials than steel may be used without departing from the scope of the invention.

As illustrated in FIG. 2, material may be removed from the rod 20, as at 26, to reduce the weight added by the rod without adversely affecting the requisite degree of structural integrity needed to support the anticipated weight of the plates. Preferably, the material is simply drilled out. In practice, the formation of a 2 inch diameter hole to a depth of 2 inches within the central portion of the rod has been found acceptable for a barbell with a 2½ diameter handle, while the formation of a 1.5 inch diameter hole to a depth of 1.5 inches has been found acceptable for a barbell with a 2¼ diameter handle. Those skilled in the art will recognize that the diameter and depth of the hole will depend on the material used to form the thick bar, as well as the target weight for the thick bar. Regardless of material utilized or the target weight, however, the described technique yields a method for gaining control over the weight of the structure with a great degree of accuracy.

Returning to FIG. 1, a circumscribing bead 28 is welded along the interface of the bar 10 and rod 20 for added-security. For that purpose, approximately 3/16 inch of the non-reduced segment of rod is left protruding from the bar, and the circumferential L-shaped notch thus formed by the rod's O.D. and the bar's end-wall is filled with the welded bead to give the assembly a nice round appearance.

A sleeve assembly 30, illustrated in FIGS. 1 and 3, is mounted for rotation on the rod segment 24. The sleeve assembly comprises an annular sleeve 32 and an annular collar 50 that has been press-fit onto the exterior of the sleeve and welded in place to limit, in the conventional manner, the longitudinally inward travel of the weight plates to be mounted on the sleeve.

The portion 34 of the sleeve extending longitudinally outward from the collar has been turned down on a lathe to an O.D. of 50 mm so that it accommodates the central 50 mm holes of standard Olympic weight plates. During production, the collar is accordingly conveniently mounted onto the sleeve at the reduced 50 mm end for press-fitting onto the larger diameter segment. The collar is preferably formed from steel when the bar 10 is steel. When the bar 10 is formed from lighter weight materials such as aluminum, for example, the collars can be formed from lighter weight materials as well; for example, rubber, vinyl, plastic, or other lightweight shock-absorbent material having a Durometer value in excess of 80.

An annular bushing 60 is mounted about the rod segment 24 between the rod and sleeve 32 to provide substantially frictionless rotation of the sleeve about the rod.

As illustrated in FIG. 2, the outward end of the rod 20 includes a central, axially-extending, threaded hole 29 sized to accommodate a shoulder bolt 42 (FIG. 4) that secures an end plug 44 to the sleeve 32. The end plug 44 caps the I.D. of the sleeve 30 and secures the sleeve against longitudinal movement with respect to the rod 20. To prevent the end plug 44 from rotational or longitudinal movement with respect to the sleeve, the plug is formed with a threaded 180° notch 46 (FIGS. 1 and 4) which mates with an abutting and identical threaded 180° notch 46 formed in the sleeve (FIGS. 1 and 3) to form a threaded aperture. As best illustrated in FIGS. 4 and 5, a set screw 47 is tightened into the aperture to prevent relative rotation between the sleeve and plug, and the screw itself is treated with a substance that minimizes the risk the set screw will work itself out of the aperture. One such substance is a high-strength thread locker such as Locktite™ sold by Locktite Corp.

Those skilled in the art will recognize that Olympic weight plates with standard 50 mm holes can now be mounted about the sleeve 32, and will freely rotate about the rod segment 24 as lifting movements cause plate rotation, thus preventing the plates from exerting torque on the bar 10.

Those skilled in the art will recognize that many variations may be made in the disclosed embodiment without departing from the spirit of the invention. The term "cylindrical", for example, is used in its broadest sense, and encompasses shapes other than those having circular circumferences. It is well known for the handles of barbells and dumbbells to comprise various shapes of bars disposed about a longitudinal axis, including but not limited to hexagonal and other types of multi-sided bars, bars with oval cross-sections, bars having knurled surfaces, and the like. Unless otherwise noted herein, the term "cylindrical" is accordingly used to encompass all such structures.

Thus, while the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto, that the term "barbell" include dumbbells within its scope, and that the claims be interpreted as broadly as permitted in light of the prior art.

We claim:

1. A barbell comprising:

a generally cylindrical bar of generally annular cross-section a generally elongated central axis having an outer diameter of between approximately 1.5 inches and 3.5 inches and extending between a pair of end regions;

a rod member securely inserted within each end region of the bar, each rod member having an outer segment extending longitudinally beyond the respective end region of the bar and having an outer diameter less than the outer diameter of the bar; and a pair of generally cylindrical sleeves mounted for rotation about the outer segment of a respective rod member, the outer diameter of each sleeve being sized to accommodate a central hole of one or more weight plates so that said one or more weight plates can rotate substantially about said central axis.

2. The bar bell of claim 1 wherein the extended segment each rod member is less than the I.D. of the bar.

3. The bar bell of claim 1 wherein the outer diameter of each sleeve is approximately 50 mm.

4. The bar bell of claim 1 wherein the outer segment of each rod includes a longitudinally-extending hole, and further including an end plug inserted into the longitudinally outward end of each sleeve, and sized to cap the inner diameter of the sleeve, said end plug having a hole aligned with the hole in the outer segment of the rod, and fastening means extending through the hole in the end plug and into the hole in the rod to secure the end plug to the barbell.

5. The barbell of claim 4 wherein the hole in tie outer segment of the rod is internally threaded, and the fastening means is externally threaded to mate with said internal threads.

6. The barbell of claim 4 wherein the end plug includes an internally threaded, longitudinally-extending notch at its periphery, and the sleeve includes an internally threaded, longitudinally-extending notch positioned to mate with the notch of the end plug to form a threaded aperture, and further including screw means within said aperture for preventing the relative movement of the plug and sleeve.

7. The barbell of claim 1 wherein the rod member includes a region of removed material sufficient in quantity to reduce the weight of the barbell to a target weight without substantially adversely affecting the requisite degree of structural integrity needed to support an anticipated weight of the weight plates, thereby gaining control over the weight of the structure with a substantial degree of accuracy.

8. The barbell of claim 7 wherein the rod member is formed about a longitudinal axis, and the region of removed material is generally symmetrically disposed about said axis.

9. The barbell of claim 7 wherein the region of removed material is a drilled hole whose dimensions are dependant on the material used to form the bar.

10. The barbell of claim 7 wherein the region of removed material is a drilled hole whose dimensions are dependant on the target weight for the bar.

11. A barbell comprising:

a generally cylindrical bar of generally annular cross-section having an outer diameter of to between approximately 1.5 inches and 3.5 inches and extending between a pair of end regions;

a rod member securely inserted within each end region of the bar, each rod member having an outer segment extending longitudinally beyond the respective end region of the bar and having an outer diameter less than the outer diameter of the bar, the outer segment of each rod including a longitudinally-extending hole, and a pair of generally cylindrical sleeves mounted for rotation about the outer segment of a respective rod member having an outer diameter and an inner diameter, the outer diameter of each sleeve being sized to accommodate a central hole of one or more weight plates, an end plug inserted into a longitudinally outward end of each sleeve, and sized to cap the inner diameter of the sleeve, said end plug having a hole aligned with the hole in the outer segment of the rod, and fastening means extending through the hole in the end plug and into the hole in the rod to secure the end plug to the barbell.

12. The barbell of claim 11 wherein the hole in the outer segment of the rod is internally threaded, and the fastening means is externally threaded to mate with said internal threads.

13. The barbell of claim 11 wherein the end plug includes an internally threaded, longitudinally-extending notch at its periphery, and the sleeve includes an internally threaded, longitudinally-extending notch positioned to mate with the notch of the end plug to form a threaded aperture, and further including screw means within said aperture for preventing the relative movement of the plug and sleeve.

14. The barbell of claim 11 wherein the rod member includes a region of removed material sufficient in quantity to reduce the weight of the barbell to a target weight without substantially adversely affecting the requisite degree of structural integrity needed to support the anticipated weight of the weight plates, thereby gaining control over the weight of the structure with a substantial degree of accuracy.

15. The barbell of claim 14 wherein the rod member is formed about a longitudinal axis, and the region of removed material is generally symmetrically disposed about said axis.

16. The barbell of claim 14 wherein the region of removed material is a drilled hole whose dimensions are dependant on the material used to form the bar.

17. The barbell of claim 14 wherein the region of removed material is a drilled hole whose dimensions are dependant on the target weight for the bar.

18. A barbell comprising:

a generally cylindrical bar of generally annular cross-section having an outer diameter of between approximately 1.5 inches and 3.5 inches and extending between a pair of end regions;

a rod member formed about a longitudinal axis and securely inserted within each end region of the bar, each rod member having au outer segment extending longitudinally beyond the respective end region of the bar and having an outer diameter less than the outer diameter of the bar; and a pair of generally cylindrical sleeves mounted for rotation about the outer segment of a respective rod member, the outer diameter of each sleeve being sized to accommodate a central hole of one or more weight plates, the rod member including a region of removed material sufficient in quantity to reduce the weight of the barbell to a target weight without substantially adversely affecting the requisite degree of structural integrity needed to support the anticipated weight of the weight plates, thereby gaining control over the weight of the structure with a substantial degree of accuracy, the region of removed material being generally symmetrically disposed about said axis.

19. The barbell of claim 18 wherein the region of removed material is a drilled hole whose dimensions are dependant on the material used to form the bar.

20. The barbell of claim 18 wherein the region of removed material is a drilled hole whose dimensions are dependant on the target weight for the bar.

* * * * *